US005099947A

United States Patent [19]

Guggenberger et al.

[11] Patent Number: 5,099,947

[45] Date of Patent: Mar. 31, 1992

[54] WAX GUARD FOR HEARING AIDS

[75] Inventors: Keith A. Guggenberger, Minnetonka; Jerome C. Ruzicka, Maple Grove, both of Minn.

[73] Assignee: Starkey Laboratories, Inc., Eden Prairie, Minn.

[21] Appl. No.: 576,874

[22] Filed: Sep. 4, 1990

[51] Int. Cl.[5] ..... H04R 25/02

[52] U.S. Cl. ..... 181/130; 181/135

[58] Field of Search ..... 181/128, 130, 135, 129; 381/68.6, 69; 128/864, 867; 267/4, 166.1, 166, 167, 190, 194, 221, 231, 237, 248-252

[56] References Cited

U.S. PATENT DOCUMENTS

Re. 27,487 9/1972 Hassler .
3,097,059 7/1963 Hoffmann .
3,565,069 2/1971 Miller .
3,605,816 9/1971 Nilsson .
3,901,359 8/1975 Jentsch .
4,375,016 2/1983 Harada .
4,498,555 2/1985 Cerny .
4,549,035 10/1985 Zaltsberg .
4,647,072 3/1987 Westman ..... 267/166
4,729,451 3/1988 Brander et al. .
4,869,704 9/1989 Fisher ..... 267/250 X

*Primary Examiner*—L. T. Hix
*Assistant Examiner*—Khanh Dang
*Attorney, Agent, or Firm*—David H. Semmes

[57] ABSTRACT

Hearing aids, particularly hearing aids of the type embodying an ear-fitted housing having an interior receiver at the receiver tube leading from the interior receiver to the exterior of the housing. Particularly, a wax guard in the form of a coil of wire which is interference-fitted within the receiver to provide a restrictive path for ear wax and, thus protect the receiver.

8 Claims, 1 Drawing Sheet

WAX GUARD FOR HEARING AIDS

BACKGROUND OF THE INVENTION

1. Field of the Invention

Hearing aids, particularly a guard or baffle for capturing migrating wax, so as to avoid wax accumulation upon the hearing aid receiver.

2. Description of the Prior Art

| | |
|---|---|
| HASSLER | Re. 27,487 |
| HOFFMANN | 3,097,059 |
| MILLER | 3,565,069 |
| NILSSON | 3,605,816 |
| JENTSCH | 3,901,359 |
| HARADA | 4,375,016 |
| CERNY | 4,498,555 |
| ZALTSBERG | 4,549,035 |
| BRANDER et al. | 4,729,451 |

The aforelisted patents are directed principally to damping sound or moisture within a conduit. The prior art does not show the use of a wax guard in the form of a biconically-shaped coil of fine wire which may be inserted into and removed from the hearing aid receiver tube.

SUMMARY OF THE INVENTION

According to the present invention, a wax guard or basket is formed from a coil of wire conformed as a cone which is then interference-fitted within the receiver tube. The cone may be miconic (i.e., a single cone) or biconic with the coil of wire configured as two axially aligned cones with their bases abutting. The wax guard provides a restrictive path for ear wax that migrates towards the receiver.

DESCRIPTION OF THE PREFERRED EMBODIMENTS

Figure 1:
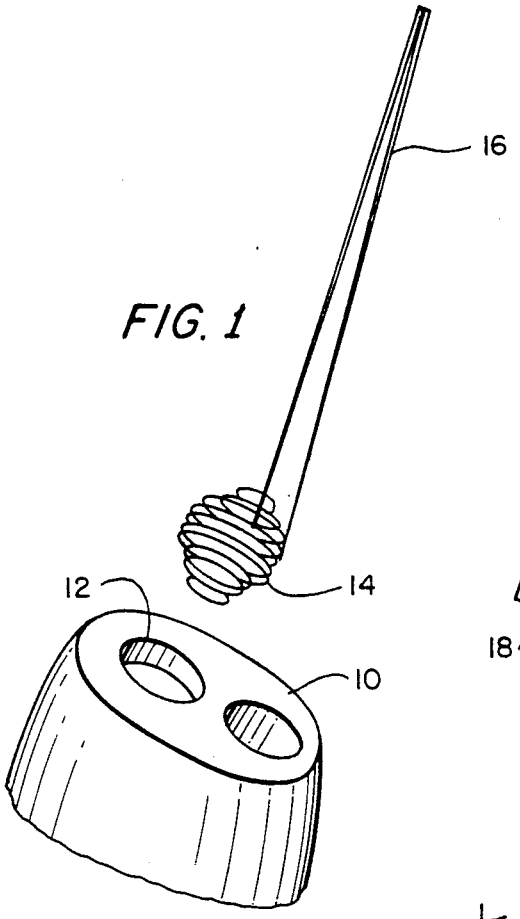
FIG. 1 is a schematic view of a biconic wax guard being fitted within the receiver tube of a hearing aid.

In FIG. 1, hearing aid 10 is illustrated as having receiver tube 12 into which is being fitted biconic wax basket 14 by means of tweezers 16.

Figure 2:
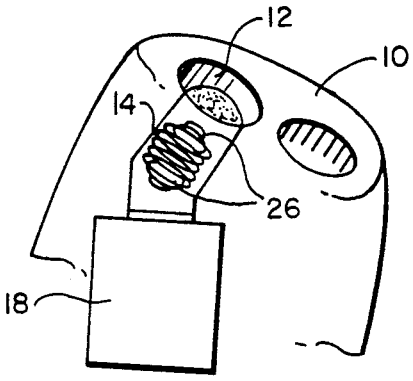
FIG. 2 is a schematic view showing the interference fitting of the biconic wax basket within the receiver tube.

In FIG. 2, biconic wax basket 14, having cone tips 26, is shown as interference-fitted within receiver tube 12 adjacent hearing aid receiver 18.

Figure 3:
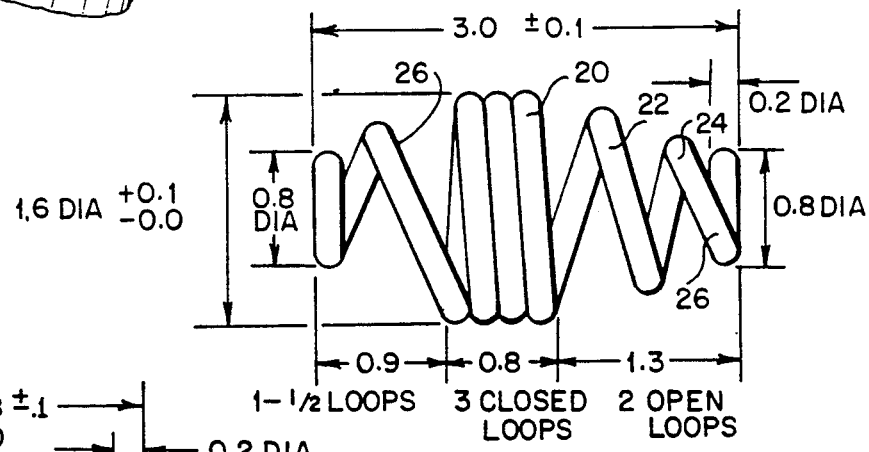
FIG. 3 is a front elevation of the biconic wax basket.

As illustrated in FIG. 3, biconic wax basket 14 is formed from a coiled wire of non-corrosive alloy of 0.2 millimeters in diameter, such that the overall length is 3 millimeters with the maximum diameter of the coil being through the closed loop portion 20 being 1.6 mm and minimum diameter of the coil through the tips 26 being 0.8 mm.

As illustrated in FIG. 3, the biconic wax basket consists of three closed loops in the center 20 with two open loops 22, 24 at one end and one-half loops at the other end.

Figure 4:
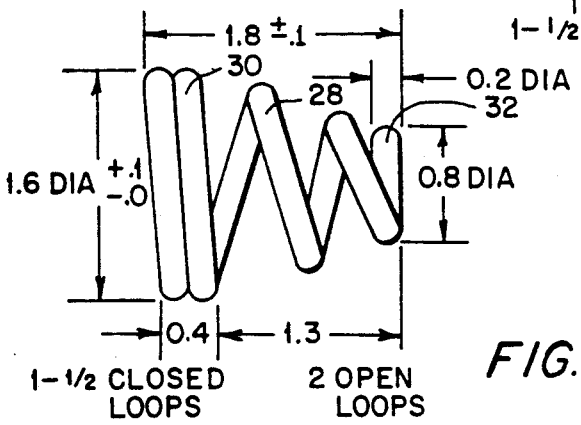
FIG. 4 is a front elevation of a miconic wax basket.

In FIG. 4 the miconic wax basket 32 is illustrated as including one and one-half closed loops 28, 32 at one end and two open loops 30 at the other end.

As will be apparent, the present device is designed to serve as a wax barrier in conventionally styled hearing aids. Earwax has been a problem for hearing aid users for many years. To help alleviate this problem, the wax basket is designed to capture migrating wax before it has a chance to contaminate the receiver. The wax guard is in the form of a small miconic or biconically shaped coil of fine wire which may be easily inserted into and removed from receiver tube 12. Conventionally, wax migrates along the receiver tube such that wax buildup on the receiver may cause a restriction of the sound as it is injected to the ear canal. If wax enters the receiver spout (not illustrated) and actually enters the receiver, replacement of the contaminated part becomes necessary.

In order to eliminate the necessity for premature replacement of a receiver, the present wax basket is designed to be placed in the path of ear wax as it attempts to migrate to the receiver. This basket is placed directly into the receiver tube and is held in place by an interference fit. As the ear wax enters into the receiver tube the ear wax will travel along the tube until it reaches the wax basket. At this point, the wax will be picked up by one of the spirals of the wax basket and will be entrapped within the conically shaped coil.

As more and more wax becomes entrapped in the biconic wax basket, there comes a time when it is necessary to replace the basket. All that is required is a simple device (not illustrated), that is capable of hooking into one of the coil spirals and gently pulling the basket out of the receiver tube and completely out of the aid. Once this is accomplished, the next step is to make sure all of the wax is out of the receiver tube. After a clear path is determined, a new biconic wax basket is interference fitted into the receiver tube using a tweezer or its equivalent. After making sure the basket is securely in place, the aid is ready for the user to again wear it.

Comparative performance advantages of the wax basket are illustrated in the following Tables:

TABLE I:

| Without Wax Basket | | |
|---|---|---|
| Model: | PEAK SSPL 90 = 106.9 dB | DISTORTION: 1/12 Oct Filter |
| Serial #: | H.F.A. SSPL 90 = 104.3 dB | 500 Hz (70 dB) = 0.6% |
| Comments: SAS#AZAX053 | H.F.A. GAIN 60 = 26.1 dB | 800 Hz (70 dB) = 3.1% |
| PEG | Ref. Test GAIN = 26.1 dB | 1600 Hz (65 dB) = 0.8% |
| Test parameters: | Eq. Input NOISE = 21.5 dB | BATTERY SIMULATOR: |
| ANSI S3.22 - 1987 | Frequency Range: 354–4490 Hz | Voltage = 1.25 V |
| | | Impedance = 2.5 Ω |
| Date: 06/12/90 | | Current = 0.01 mA |
| Time: 13:01 | | TPU COIL = — dB |

TABLE II:

| With Wax Basket | | |
|---|---|---|
| Model: | PEAK SSPL 90 = 106.8 dB | DISTORTION: 1/12 Oct Filter |
| Serial #: | H.F.A. SSPL 90 = 104.4 dB | 500 Hz (70 dB) = 1.8% |
| Comments: SAS#AZAX053 | H.F.A. GAIN 60 = 26.6 dB | 800 Hz (70 dB) = 0.9% |
| PEG | Ref. Test GAIN = 26.6 dB | 1600 Hz (65 dB) = 0.6% |
| Test parameters: | Eq. Input NOISE = 23.7 dB | BATTERY SIMULATOR: |
| ANSI S3.22 - 1987 | Frequency Range: 354–4490 Hz | Voltage = 1.25 V |
| | | Impedance = 2.5 Ω |
| Date: 06/12/90 | | Current = 0.00 mA |
| Time: 12:58 | | TPU COIL = — dB |

Manifestly, variations in the formation of the wax basket may be employed without departing from the spirit and scope of the invention.

I claim:

1. A hearing aid of the type embodying an ear-fitted housing having an exterior receiver and a receiver tube, comprising:

a. a housing with an ear-fitted exterior, an interior receiver mounted within the housing and a receiver tube leading from the interior receiver to the exterior of the housing in combination with a wax guard conformed as a coil of wire cone which is interference fitted within the receiver tube.

2. A hearing aid of the type embodying an ear-fitted housing having an interior receiver and a receiver tube as in claim 1, said wax guard having a Biconic configuration in the form of a coil of wire formed as abutting axially aligned cones fitted together at their base, so as to form a wire basket which is positioned within the receiver tube.

3. A hearing aid of the type embodying an ear-fitted housing having an interior receiver and a receiver tube as in claim 2, said coil of wire being selectively removable from the receiver tube.

4. A hearing aid of the type embodying an ear-fitted housing having an interior receiver and a receiver tube as in claim 3, said wire having an approximate diameter of 0.20 mm and being composed of a non-corrosive alloy.

5. A hearing aid of the type embodying an ear-fitted housing having an interior receiver and a receiver tube as in claim 4, said coil being formed in six and one-half continuous loops as follows:

i. three closed loops in the middle, ii. two open loops at one end, and iii. one and one-half open loops at the other end.

6. A hearing aid of the type embodying an ear-fitted housing having an interior receiver and a receiver tube from three and one-half continuous loops as follows:

i. two closed loops at one end of said coil;

ii. one and one-half closed loops at either end of said coil.

7. A hearing aid embodying an ear-fitted housing having an interior receiver and a receiver tube as in claim 6, wherein said coil of wire is positioned within said receiver tube with an interference fit.

8. A wax guard for hearing aids embodying an ear-fitted housing having an interior receiver and a receiver tube leading from the interior receiver to the exterior of the housing as in claim 7, wherein said coil has a mid-section diameter of approximately 1.6 mm and a tip diameter of approximately 0.8 mm.

* * * * *